United States Patent [19]

Brauer

[11] Patent Number: 4,706,884

[45] Date of Patent: Nov. 17, 1987

[54] HOT AIR HEATING SYSTEM

[76] Inventor: Robert C. Brauer, 2123 N. 89th St., Milwaukee, Wis. 53226

[21] Appl. No.: 649,842

[22] Filed: Sep. 11, 1984

Related U.S. Application Data

[63] Continuation-in-part of Ser. No. 453,746, Dec. 27, 1982, abandoned, which is a continuation of Ser. No. 365,496, Apr. 4, 1982, abandoned.

[51] Int. Cl.[4] ..... F24B 7/00

[52] U.S. Cl. ..... 237/55; 126/113; 165/901

[58] Field of Search ..... 126/113, 101, 117; 237/55, 50, 51; 165/DIG. 2, DIG. 18, 171, 90; 122/20 B

[56] References Cited

U.S. PATENT DOCUMENTS

| | | | |
|---|---|---|---|
| 428,756 | 5/1890 | Johnston | 237/54 X |
| 757,074 | 4/1904 | Vaughn | 237/54 |
| 1,788,447 | 1/1931 | Buck | 126/113 |
| 2,242,802 | 5/1941 | Stramaglia | 126/113 |
| 3,834,798 | 1/1976 | Goldsmith | 237/55 |
| 4,028,817 | 6/1977 | Winstel | 34/86 |
| 4,138,062 | 2/1979 | Graden | 237/55 |
| 4,175,518 | 11/1979 | Reames, Jr. | 122/20 B |
| 4,241,874 | 12/1980 | Schossow | 237/55 |
| 4,318,367 | 3/1982 | Antonucci | 237/1 R X |
| 4,485,746 | 12/1984 | Erlandsson | 122/20 B |

*Primary Examiner*—Henry A. Bennet

*Attorney, Agent, or Firm*—Andrus, Sceales, Starke & Sawall

[57] ABSTRACT

A hot air heating system utilizing the otherwise wasted heat and water vapor in the gases of combustion to pre-heat air supplied to the combustion unit. The hot combustion gases discharged from the combustion unit are mechanically induced by a blower to pass through an auxiliary heat exchanger in countercurrent flow to the air being supplied to the combustion unit, thereby preheating the return air and cooling the combustion gases. The products of combustion include a considerable quantity of water vapor. Cooling the combustion gases results in condensation of the water vapor, which is then collected and can be utilized to humidify the room air. Condensation of the vapors releases their latent heat of vaporization adding considerably to the heat recovery of the system.

6 Claims, 6 Drawing Figures

HOT AIR HEATING SYSTEM

This application is a continuation-in-part of application Ser. No. 453,746, filed Dec. 27, 1982, now abandoned, which in turn is a continuation of application Ser. No. 365,496, filed Apr. 4, 1982, now abandoned.

BACKGROUND OF THE INVENTION

Most heating systems depend on convection of hot exhaust gases to draw combustion air into the furnace and to discharge the exhaust gases to the atmosphere. In recent years, primarily since the concern over energy shortages and the increased cost of energy, some domestic heating systems have been equipped with a blower to induce the circulation of air through the combustion chamber and to exhaust the products of combustion to the atmosphere. This system gains efficiency because the optimum quantity of combustion air, technically termed the stoichiometric air/fuel ratio, can be more readily controlled and also because it avoids the heat loss that occurs with a natural convection system which tends to draw warm air out of the furnace room even when the system is not operating.

More advanced versions of the force draft system reclaim some of the heat in the exhaust gases through an auxiliary heat exchanger of some type, as shown in U.S. Pat. Nos. 3,813,039, 3,934,798 and 4,241,874. The exhaust gases generally leave the combustion chamber at temperatures in the range of approximately 450° F. This is reduced in the auxiliary heat exchanger and the heat derived from this heat exchanger is then used in one manner or another.

SUMMARY OF THE INVENTION

The invention relates to a heating system which utilized the gases of combustion to pre-heat air, either return room air or combustion air, and which can utilize the condensate generated through cooling of the combustion gases to humidify circulating room air. As a separate unit it can retrofit to an existing furnace or be installed as an auxiliary unit with a new furnace.

With the invention, the hot gases of combustion from the furnace are drawn through an auxiliary heat exchanger, which is located in the combustion or return air duct, by a blower so the combustion gases, preferably, pass in countercurrent relation to the air, thereby pre-heating the air before it enters the furnace.

By utilizing the waste gases of combustion, including the latent heat of vaporization of the water vapor contained therein, to preheat the return air, a substantial energy savings is achieved and a resulting increase in efficiency up to 98% is obtained.

As the cooling of the combustion gases results in condensation of considerable quantities of water, the condensate can be employed to humidfy the return air being returned to the furnace in a hot air heating system. In one form of the invention, the condensate is collected in a sump outside the heat exchanger, and room air, being circulated by the furnace, passes across the body of condensate in the sump, so that the return air will be humidified. In an alternate manner, the condensate may be delivered to a conventional humidifier located in the return air duct or it can be conducted to a sump in the heated air duct where it will be picked up by the heated circulating room air.

The humidifying system has a further advantage over conventional humidification systems which rely on tap water for humidification, in that the condensate, which is used for humidification, is free of dissolved salts or minerals, so there will be no precipitation of salts or minerals as the water is evaporated by the circulation of air.

The water is removed from the heat exchanger through a water trap so that the exhaust gases do not contaminate the room air. The water trap can be transparent plastic or glass so it can be observed if the correct pressure (positive or negative) is being maintained within the heat exchanger. A negative pressure is preferred in order to avoid the possible contamination of the room air by the products of combustion.

The invention also incorporates a provision for preventing possible contamination of the room air with combustion gases in case of a defect in the auxiliary heat exchanger. The gases of combustion are drawn through the heat exchanger by a blower located downstream of the heat exchanger so the induced draft results in negative pressure within the heat exchanger coils. This will prevent leakage of exhaust gases into the room air in the event a crack or other defect would appear in the heat exchanger. In addition, a restrictor or flow control device is located upstream of the auxiliary heat exchanger which acts to further increase the value of the negative pressure in the heat exchanger coils. As a further safety factor, a vacuum breaker door is located in the air duct and is constructed to open at a predetermined vacuum. This would be advisable if the vacuum in the duct should exceed the vacuum in the heat exchanger, which would cause combustion gases to be drawn out of the heat exchanger and into the room air through any defect that might occur in the heat exchanger. For example, if the pressure in the air duct should decrease below a predetermined value, the vacuum breaker will open to provide atmospheric pressure in the return duct and thereby prevent any possible leakage of flue gases from the auxiliary heat exchanger coil into the return duct. This is an important safety consideration.

The induced draft system also eliminates the need of a chimney as the waste gases of combustion can be directly discharged to the atmosphere by operation of the blower, without relying on thermal convection.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
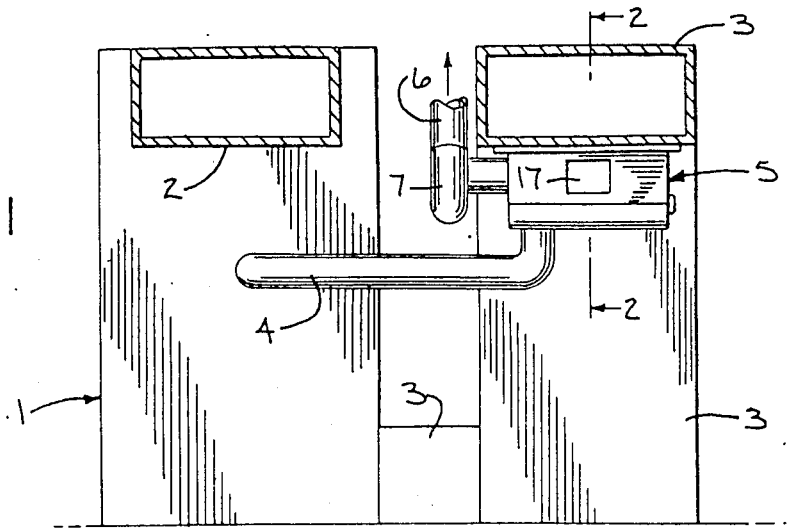
FIG. 1 is a side elevational view of a hot air heating system incorporating the invention.

FIG. 1 illustrates a typical hot air heating system including a furnace 1 having a fuel burning unit which acts to heat air flowing through the heating plenum in the furnace. A blower, not shown, discharges air from the furnace through a supply duct 2 to the rooms or other area to be heated and the cool air is returned to the furnace through a return duct 3.

In accordance with the invention, the hot waste gases of combustion pass from the furnace through a conduit 4, then flow through a heat exchanger 5 that is mounted within the return air duct 3 and are discharged through a pipe 6 to the atmosphere. Blower 7 is mounted in the pipe 6 and provides a forced draft to draw air into the combustion chamber and the waste gases resulting from combustion out through the heat exchanger 5 and outlet pipe 6.

Figure 2:
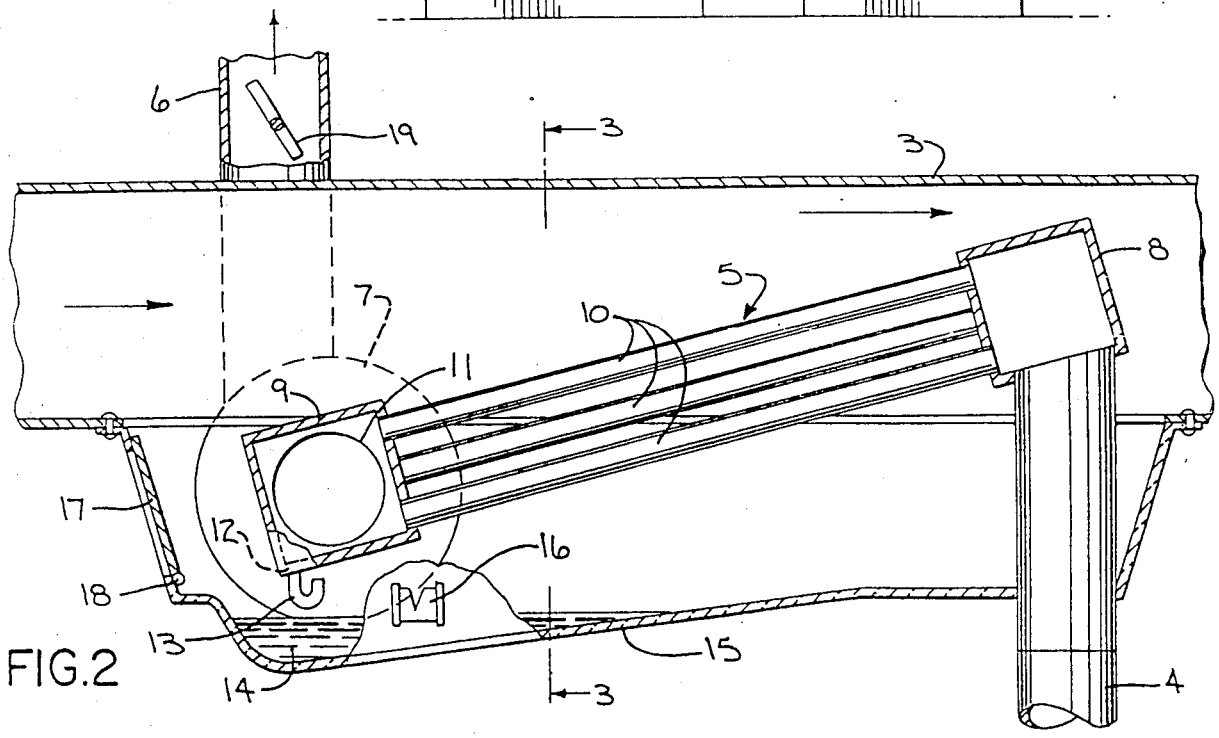
FIG. 2 is a vertical section showing the heat exchanger in a horizontal return air duct.
Figure 3:
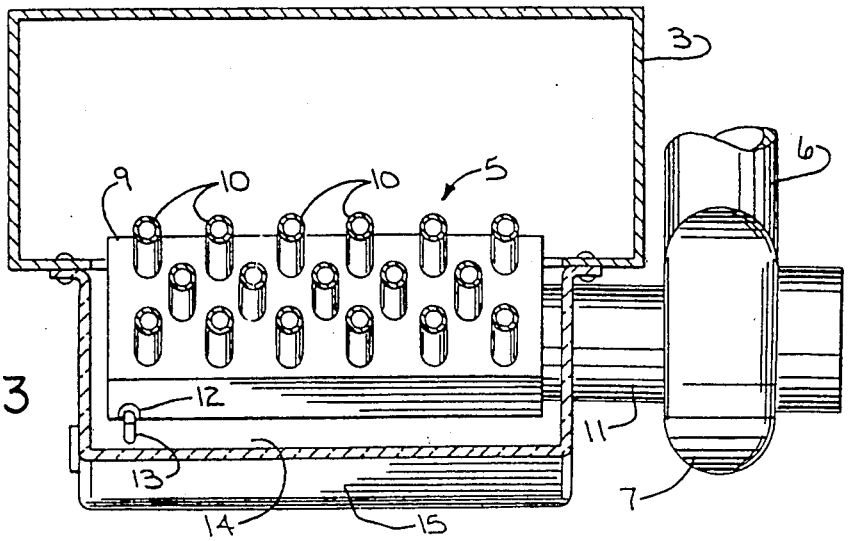
FIG. 3 is a section taken along line 3—3 of FIG. 2.

The heat exchanger 5 includes an inlet header 8 and an outlet header 9, which are connected by a plurality of tubes 10. The headers 8 and 9 have a generally tubular configuration and, as shown in FIG. 2, the inlet header 8 is preferably located at a higher level than the outlet header 9.

The waste gases of combustion enter the inlet header 8 through the conduit 4 and then pass through the tubes 10 and are discharged from the header 9 through conduit 11 to outlet pipe 6. The cool return air flowing through return duct 3 passes in heat transfer relation across the headers 8 and 9 and tubes 10 and heat is thereby transferred from the combustion gases, which are normally at a temperature in the range of 450° F. to 475° F. to the return air, which is generally at a temperature in the range of 60° F. to 65° F.

The heat transfer to the return air and the resulting cooling of the combustion gases results in the condensation of considerable quantities of water and the condensate flows downwardly through tubes 10 to the header 9.

To collect the condensate, the lower end of header 9 is provided with a drain 12, which is connected to a U-shaped water trap 13 that extends downwardly from header 9. One leg of trap 13 is connected to drain 12, while the other leg communicates with a sump 14, so that condensate will drain through trap 13 into sump 14 without permitting the exhaust gases to escape at this location. The difference in condensate level in the two legs of trap 13 is an indication of the pressure differential between the return duct 3 and heat exchanger 5.

The sump 14 is preferably formed of transparent material and the lower surface 15 is sloped so that an increasing volume of water will present an increasing surface area to the circulating room air. The proper design of the sloped surface 15, or a combination of slopes will provide an approximate balance between the need for humidification and the availability of the water to provide the humidification.

If closer control of humidification is desired, the level of water in the sump 13 can be controlled through use of an adjustable outlet or wier 15 which is mounted for sliding movement with respect to an overflow opening in the side wall of the sump. The outlet 16 can be controlled manually or by a humidistat to adjust the water level in the sump, thereby adjusting the surface area of water available to be picked up by the circulating room air. The overflow, if any, from the humidifier can be connected through a suitable pipe or hose, not shown, to a drain.

A provision is made to prevent possible contamination of the room air by the combustion gases in the auxiliary heat exchanger if a defect should occur in the heat exchanger coils. This is accomplished by locating the exhaust blower downstream of the heat exchanger and utilizing a vacuum breaker to insure that a negative pressure differential is maintained between the pressure in the return air duct and the combustion gas pressure in the coils of the heat exchanger. The vacuum breaker may take the form of a flap or damper 17 connected to rod 18 which is mounted for pivoting movement in the side walls of the housing. Flap 17 is spring loaded or biased by gravity to a closed position and a predetermined positive pressure differential between the atmosphere and the pressure in the return duct 3 will cause the flap 17 to open to maintain substantial atmospheric pressure in the return duct. This insures that the pressure in duct 3 will be greater than the pressure in the coils of the heat exchanger, thereby preventing the possibility of any contamination of room air with the products of combustion. This also insures an adequate supply of circulating air to the room air blower of the furnace, even if the cold air returns are inadequate in size or blocked by furniture, carpeting, or other items.

A damper 19, restrictive orifice, or other flow control device, can be provided in the flue gas conduit, such as outlet pipe 6, and can be adjusted in position or selected to provide the optimum air/fuel ratio.

The water trap 13 is preferably formed of transparent material, and as such enables the operator to visually determine the differential in liquid height in the two legs of the trap which corresponds to the pressure differential between duct 3 and heat exchanger 5. By adjustment of damper 19, the pressure differential, as seen in trap 13, can be controlled to obtain the desired air/fuel ratio for optimum efficiency of the system.

The invention provides a substantial energy saving by using the heated combustion gases to preheat the return room air. In addition, the condensate from cooling the combustion gases can be utilized to humidify the room air, which also saves energy by making a lower thermostat setting more comfortable to the occupants. The humidification system utilizes moisture condensed from the products of combustion to humidify the circulating room air with water free of minerals that would tend to cause problems in conventional humidifiers.

As the combustion gases are drawn through the heat exchanger by blower 7, which is located on the downstream side of the heat exchanger 5, a negative pressure results in the heat exchanger which prevents leakage of the combustion gases into the return air stream in the event of a defect or fracture of the heat exchanger tubes. The vacuum breaker 17 in the return air systems insures that a negative pressure differential is maintained between the air pressure in the duct and the exhaust gas pressure inside the heat exchanger.

The construction of the invention is simple and economical to manufacture and maintain, and is readily adapted to existing heating systems, as well as new installations, because it is incorporated in the return air duct rather than into the furnace itself.

Figure 4:
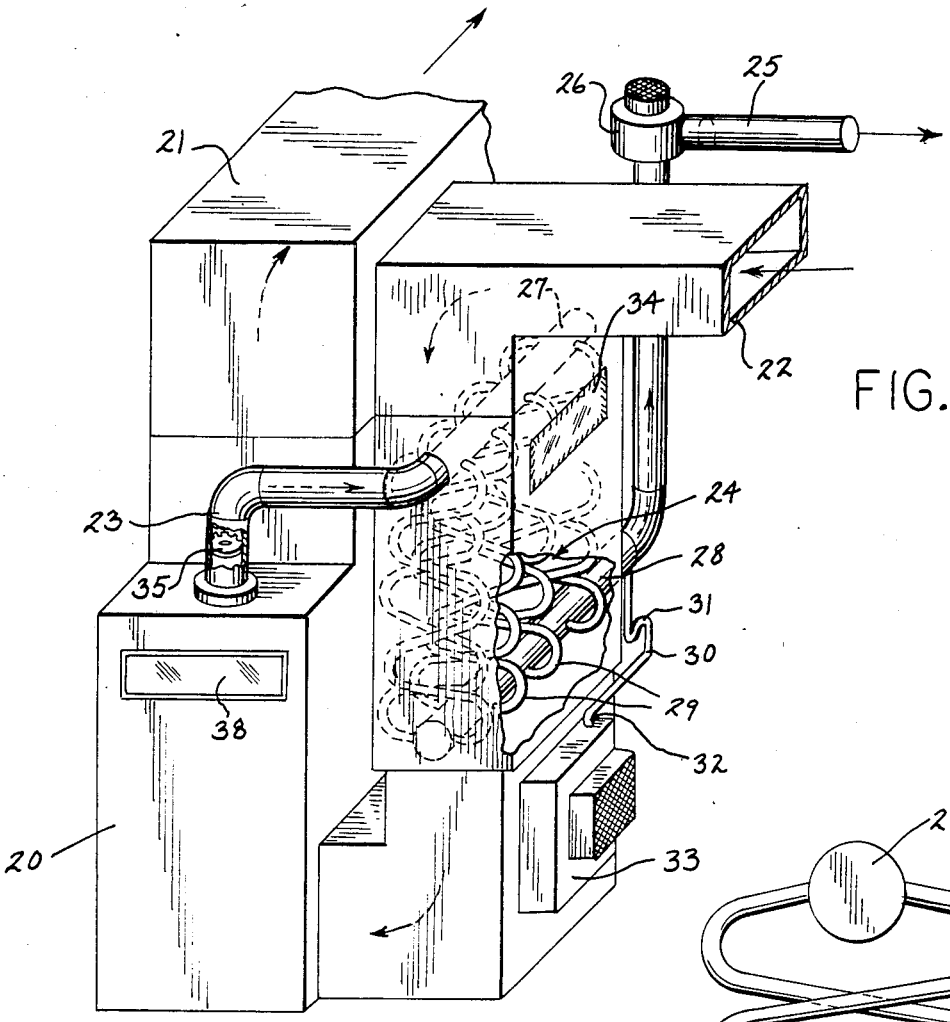
FIG. 4 is a perspective view of a modified form of the invention.
Figure 5:
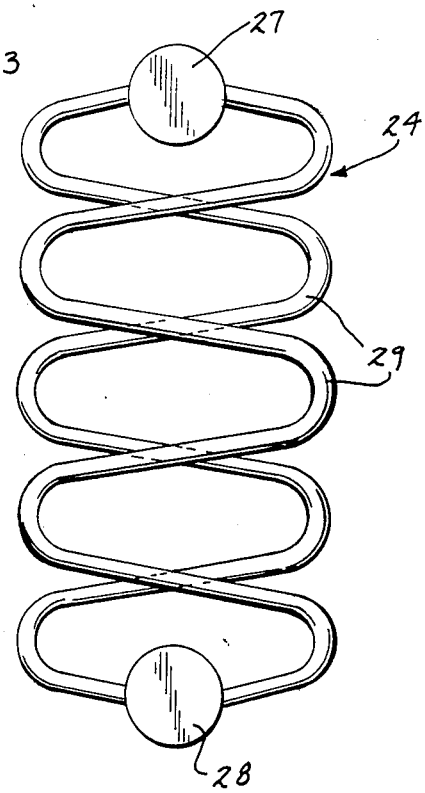
FIG. 5 is a plan view of the heat exchanger coils.
Figure 6:
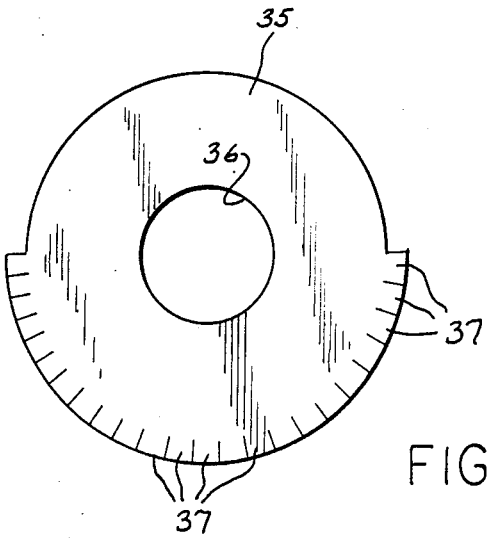
FIG. 6 is a plan view of a vent restrictor.

FIGS. 4–6 illustrate a modified form of the invention in which the auxiliary heat exchanger of the invention is utilized to preheat return room air. The system of FIGS. 4–6 includes a furnace 20 having a primary combustion and heat exchange unit which acts to heat air flowing through the heating plenum in the furnace. A blower, not shown, discharges heated air from the furnace through a supply duct 21 to the rooms or other areas to be heated and the cool room air is returned to the furnace through a return duct 22.

The hot waste gases of combustion are discharged from the furnace 20 through a flue 23, then flow through an auxiliary heat exchanger 24 are discharged through flue 25 to the atmosphere. Blower 26 is mounted in flue 25 and provides an induced draft to draw air into the combustion chamber of the furnace and draw the waste gases out through the auxiliary heat exchanger 24 and flue 25.

Auxiliary heat exchanger 24 includes an inlet header 27 and an outlet header 28 which are connected by a plurality of serpentine-shaped tubes or coils 29. As best illustrated in FIG. 5, the serpentine tubes are alternated in pattern to minimize restriction to air flow through the return air duct 22 and to create turbulence, both within the coils and within the return air duct, to improve heat transfer from the waste gases to the return air.

The outlet header 28 is sloped downwardly and condensate generated by cooling of the waste gases will flow downwardly through the tubes 29 into the header 28 and will be discharged through a drain line 30. Drain line 30 includes a trap 31 similar in construction and function to trap 13. As previously noted, the trap 31 permits the discharge of condensate, but will prevent the discharge of waste gases through the line 30.

The lower portion 32 of drain line 30 can be connected to a suitable drain, or alternately, as shown in FIG. 4, the line 33 can be connected to a conventional humidifier 3 which is mounted in the return duct 22 at a location downstream of the auxiliary heat exchanger 24.

As in the case of the first embodiment, a vacuum breaker is incorporated in the return duct 22 to insure a negative pressure differential is maintained between the pressure in the return duct 22 and the pressure within the heat exchanger tubes 29. The vacuum breaker, as shown in FIG. 4, takes the form of a flap or door 34 which is hinged to the return duct 22 and is maintained in a closed position through a magnetic catch or a spring bias mechanism. The breaker door 34 is adapted to open under a predetermined pressure differential to restore atmospheric pressure within the return duct 22, as previously described.

To further increase the negative pressure within the tubes or coils 29 and the heat exchanger, a flow control mechanism is disposed in the flue 23. The flow control mechanism, can take the form of a resistor 35 having a central orifice 36 of predetermined area. As illustrated in FIG. 6, the resistor 35 is provided with a series of outwardly extending, bendable tabs 37. Resistor 35 is inserted within a slit in the flue 23 and the tabs are then bent alternately upwardly and downwardly to hold the resistor in position and the slit can then be covered with high temperature metallic tape. The resistor 35 not only increases the negative pressure within the coils of the heat exchanger 24, but also serves to control the air-fuel ratio in the furnace.

The normal gas-fired furnace is provided with a draft diverter opening which prevents downdrafts and possible extinguishing of the pilot light or burner flame. With the heating system of the invention, the draft diverter opening can be enclosed by a closure 38 which further aids in preventing heat loss from the furnace room to the atmosphere.

In operation, the waste gases of combustion from furnace 20 are discharged through flue 23 to the auxiliary heat exchanger 24 where the hot gases serve to preheat the room air being returned to the furnace through the return duct 22. As previously noted, the alternating serpentine or sinusoidal construction of the coils 29 minimizes restriction to air flow and increases the heat transfer. After passing through the heat exchanger the waste gases are discharged through the flue 25 to the atmosphere.

Condensate generated by cooling of the waste gases is discharged through the drain line 30 and trap 31 to the humidifier 33 where the condensate can be utilized to humidify the return air being returned to the furnace.

While the drawings have specifically illustrated the auxiliary heat exchanger utilized to pre-heat return room air, the auxiliary heat exchanger can also be used in a similar manner to pre-heat combustion air being supplied to a combustion unit, such as a furnace, boiler, water heater, or the like.

Various modes of carrying out the invention are contemplated as being within the scope of the following claims particularly pointing out and distinctly claiming the subject matter which is regarded as the invention.

I claim:

1. A hot air heating system, comprising a furnace to burn a fuel and heat air passing through the furnace, a supply duct connected to the furnace for supplying heated air to a zone to be heated, a return duct for returning cool air from said zone to the furnace, a flue gas conduit connected to the furnace for discharging hot flue gases, a heat exchanger disposed within the return duct and having an inlet connected to said flue gas conduit, said heat exchanger having an outlet, a discharge conduit connecting the outlet of the heat exchanger to the atmosphere, a blower located in the discharge conduit for drawing the flue gases through the heat exchanger and discharging the flue gases to the atmosphere, heat from the flue gases being transferred to the return air in said return duct to thereby pre-heat the return air and cool said flue gases, a sump located below the heat exchanger for collecting water condensed from the cooled flue gases, said heat exchanger having an outlet in the lower end thereof, said sump disposed in the return duct beneath said outlet, and flow control means for permitting the flow of condensate through said outlet to said sump and for preventing the flue gases from passing through said outlet to said sump, said return air passing over the water in said sump to thereby humidify the return air, said flow control means comprising a generally U-shaped tubular member having a pair of vertically extending legs, one of said legs connected to said outlet and the other of said legs communicating with said sump.

2. The heat system of claim 1, wherein said heat exchanger has a high end and a low end, and said sump is located at the low end of the heat exchanger.

3. The system of claim 1, wherein said tubular member is transparent whereby the differential in level of condensate in said legs can be observed.

4. A heating system, comprising a combustion unit to burn a fuel, an air duct connected to the combustion unit, exhaust gas conduit means connected to the combustion unit for discharging exhaust gases of combustion, heat exchange means including an outer casing constituting a part of said air duct whereby air being supplied to said combustion unit will flow through said casing, said heat exchanger means also including a first header disposed within said casing and a second header spaced beneath the level of said first header and a plurality of tubes lying in parallel planes and extending between said first and second headers and sloping downwardly toward said second header, each of said tubes being disposed in a single plane and having a generally sinusoidal configuration, each tube being composed of a plurality of generally U-shaped portions connected by intermediate portions, the U-shaped portions of each tube being disposed out of alignment and offset from the U-shaped portions of adjacent tubes, a discharge conduit connecting said second header to the atmosphere, blower means for passing exhaust gases through said heat exchange means with heat from the exhaust gases being transferred to the air in said duct to thereby preheat the air and cool said exhaust gases, condensation from the cooled exhaust gases being collected in said second header, and means for removing said condensation from said second header.

5. In a hot air heating system, a furnace to burn a fuel and including a heat exchange unit to heat air passing through the furnace, an air duct connecting a zone to be heated with the furnace for supplying air to be heated to said furnace, exhaust gas conduit means connected to the furnace for discharging exhaust gases of combustion, heat exchange means interconnecting the air duct with said conduit means, said heat exchange means being constructed and arranged to transfer heat from said exhaust gases to the air in said duct to thereby preheat the air and cool the combustion gases, a blower in said conduit means and located downstream of said heat exchange means, said blower being constructed to create a negative pressure in the heat exchanger and draw exhaust gases through said heat exchange means, said air duct having an opening disposed upstream with respect to the direction of air flow in said air duct from said heat exchange means, said opening providing communication between the interior of said duct and the atmosphere, a movable closure to open and close said opening, biasing means for biasing said closure to a closed position, said biasing means being constructed and arranged to be overcome by a predetermined negative pressure in said air duct to thereby open said closure and maintain substantially atmospheric pressure in said duct, and flow restrictor means disposed in said exhaust gas conduit and located upstream in the direction of exhaust gas flow from said heat exchange means, for increasing the magnitude of the negative pressure of said exhaust gases flowing through the heat exchanger.

6. The system of claim 5, wherein said flow restrictor means is an orifice of fixed cross sectional area.

* * * * *